United States Patent [19]

Richter

[11] Patent Number: 4,704,137

[45] Date of Patent: Nov. 3, 1987

[54] PROCESS FOR UPGRADING WATER USED IN COOLING AND CLEANING OF RAW SYNTHESIS GAS

[75] Inventor: George N. Richter, San Marino, Calif.

[73] Assignee: Texaco Inc., White Plains, N.Y.

[21] Appl. No.: 12,535

[22] Filed: Feb. 9, 1987

[51] Int. Cl.[4] ..... C10J 3/46

[52] U.S. Cl. ..... 48/197 R; 48/206; 48/215; 252/373; 423/236; 423/244; 423/245; 423/655; 423/656

[58] Field of Search ..... 48/197 R, 206, 209, 48/210, 215; 252/373; 423/655, 656, 236, 244, 245 S

[56] References Cited

U.S. PATENT DOCUMENTS

| | | | |
|---|---|---|---|
| 3,850,841 | 11/1974 | Aldridge et al. | 423/655 |
| 3,878,289 | 4/1975 | Beavon | 423/236 |
| 4,021,366 | 5/1977 | Robin et al. | 252/373 |
| 4,110,359 | 8/1978 | Marion | 252/373 |
| 4,161,393 | 7/1979 | Rudolph et al. | 48/197 R |
| 4,189,307 | 2/1980 | Marion | 48/197 R |
| 4,205,963 | 6/1980 | Marion et al. | 48/197 R |
| 4,536,382 | 8/1985 | Blytas | 423/437 |

*Primary Examiner*—Peter Kratz

*Attorney, Agent, or Firm*—Robert A. Kulason; James J. O'Loughlin; Albert Brent

[57] ABSTRACT

This process relates to the upgrading of at least one stream of condensate water by removing water soluble gaseous impurities from the group consisting of HCN, COS, HCOOH, and mixtures thereof as produced in a process for the production of synthesis gas by the partial oxidation of solid carbonaceous fuel and/or liquid hydrocarbonaceous fuel. In the process, at least one internally produced condensate stream of water containing the aforesaid water soluble gaseous impurities is mixed with and vaporized into a stream of synthesis gas. The vaporized mixture is then introduced into at least one bed of catalyst where the gaseous impurities are removed by hydrolysis. The upgraded water stream is then recycled in the process for use in cooling and/or scrubbing the hot raw effluent gas stream from a partial oxidation gas generator. The condensate water streams are obtained by (i) cooling a portion of the cooled and scrubbed effluent stream of synthesis gas to below the dew point temperature; and/or (ii) cooling and flashing a portion of the quench water used to quench cool and clean the hot raw effluent stream of synthesis gas thereby producing a gaseous mixture comprising $H_2O$, HCN, COS, HCOOH, and mixtures thereof and cooling said gaseous mixture to condense out and separate condensed water containing said water soluble gaseous impurities.

16 Claims, 1 Drawing Figure

FUEL
OXIDANT

PROCESS FOR UPGRADING WATER USED IN COOLING AND CLEANING OF RAW SYNTHESIS GAS

BACKGROUND OF THE INVENTION

Field of the Invention

This invention relates to the production of cooled and cleaned gaseous mixtures comprising $H_2+CO$ by the partial oxidation of liquid hydrocarbonaceous and/or solid carbonaceous fuel. More particularly, it pertains to a partial oxidation process for the production of synthesis gas in which water is used to quench cool and scrub the hot raw effluent stream of synthesis gas from the free-flowing refractory lined partial oxidation reaction zone, and said water is upgraded and recycled.

The partial oxidation of a carbonaceous fuel with a free-oxygen containing gas, in a free flow, non-catalytic synthesis gas generator at a temperature in the range from about 1800° F. to about 3000° F., and a pressure in the range from about 1 to about 250 atmospheres, produces a hot raw stream of gases comprising $H_2$, CO and mixtures thereof. Depending on the actual composition, this gas stream is referred to as synthesis gas, reducing gas, or fuel gas. The term synthesis gas pertains to gaseous mixtures substantially comprising $H_2$ and CO for use in catalytic chemical synthesis. Reducing gas is rich in $H_2$ and CO and defficient in $H_2O$ and $CO_2$. Fuel gas contains increased amount of $CH_4$. However, whatever is said for synthesis gas hereafter, will in most instances apply to reducing gas and fuel gas. The raw effluent gas from the partial oxidation gas generator comprises a mixture of carbon monoxide (CO), hydrogen ($H_2$), carbon dioxide ($CO_2$), water, and minor quantities of ammonia ($NH_2$), argon (Ar), nitrogen ($N_2$), methane ($CH_4$), and some gases of environmental concern, such as hydrogen cyanide (HCN), hydrogen sulfide ($H_2S$) and carbonyl sulfide (COS). The quantity of these latter gases produced depends on the quantity of sulfur and nitrogen in the carbonaceous fuel used and the operating conditions of the gasifier. Gaseous carbonaceous fuels, such as natural gas and petroleum distillates, contain very little or no sulfur and nitrogen. Liquid carbonaceous fuels such as crude oil residue, organic waste materials, sewer sludge, and liquefied coal fractions; as well as solid carbonaceous fuels such as petroleum coke, subbituminous, bituminous and anthracite coal, lignite, shale and solid organic waste materials have larger quantities of sulfur and nitrogen.

In recent years, because of the decreasing availability of gaseous carbonaceous fuels, the various liquid and solid carbonaceous fuels are being used in larger quantities as feedstocks for processes for the production of synthesis gas. Liquid, and even more so, solid carbonaceous feedstocks, contain in addition to the relatively large quantities of nitrogen and sulfur, other impurities including various inorganic materials. The impurities produce not only the gas by-products previously mentioned, but they also produce nonvolatile by-products, such as insoluble fly ash, slag, and various soluble solids including halide salts.

Generally, most of the partial oxidation by-products are removed from the raw synthesis gas before it is further processed or used. Cleaning of the raw synthesis gas, which generally comprises removal of water soluble gaseous by-products is usually necessary because many of the partial oxidation by-products are air pollutants. Further, some of the by-products can damage equipment and deactivate catalysts used to further treat the synthesis gas. For instance, dissolved hydrogen cyanide can corrode the steel piping and vessels used in the processing of the synthesis gas and can deactivate oxo and oxyl catalysts.

In a coassigned U.S. Pat. No. 4,211,646, issued to C. Westbrook et al. and incorporated herein by reference, a novel effective waste water treatment process is disclosed. However, when large quantities of hydrogen cyanide are present in the waste water, large quantities of ferrous ions are required to precipitate the cyanide. Further, disposal is required of large quantities of precipitated cyanide formed in the process. If not all of the cyanide is precipitated in the chemical portion of the treatment process, the remaining cyanide ions can adversely affect the biological reactor used to further treat the waste water.

Other previously known methods of eliminating hydrogen cyanide from waste water are not completely satisfactory since either gaseous hydrogen cyanide, or some precipitate of the cyanide ion must still be disposed of. In coassigned U.S. Pat. No. 4,189,307, issued to Marion, all or part of the hydrogen cyanide containing waste water is returned to the gas generator where the partial oxygenation process therein destroys at least a portion of the hydrogen cyanide.

In U.S. Pat. No. 4,007,129, issued to Naber et al., the acid gases are removed from the raw synthesis gas by being dissolved into a salt solution which is removed and stripped to remove the dissolved hydrogen cyanide and other acid gases. The stripped acid gases must then be disposed of.

U.S. Pat. No. 3,935,188, issued to Karwat, discloses the use of an organic scrubbing agent for the removal of hydrogen cyanide from synthesis gas. After contacting the synthesis gas with the organic scrubbing agent an aqueous alkali metal or alkaline earth metal hydroxide solution is mixed with the hydrogen cyanide rich organic scrubbing agent to form the cyanide salt. The salt solution is subsequently heated to at least 150° C. to thermally convert the cyanide salt to ammonia and formate.

In U.S. Pat. No. 2,989,147, issued to Gollmar, hydrogen cyanide dissolved in the waste water is removed by passing the waste water through a series of aeration towers which utilize air and carbon dioxide gas to remove the hydrogen cyanide from the waste water. However, disposal of the gaseous hydrogen cyanide is still required.

SUMMARY OF THE INVENTION

This invention relates to a process for the production of gaseous mixtures comprising $H_2+CO$ by partial oxidation of a feedstock comprising solid carbonaceous and/or liquid hydrocarbonaceous fuel. In the process the solid carbonaceous and/or liquid hydrocarbonaceous fuel feedstock is reacted in a free-flow reaction zone of a partial oxidation gas generator to produce a hot raw effluent gas stream at a temperature in the range of about 1800° F. to 3000° F. and a pressure in the range of about 5 to 200 atmospheres; wherein said hot raw effluent gas stream comprises $H_2$, CO, $H_2O$; at least one water soluble gaseous impurity from the group consisting of HCN, COS, HCOOH, and mixtures thereof; at least one gaseous impurity from the group consisting of $CO_2$, $H_2S$, $NH_3$; and entrained particulate solids and/or molten slag. The hot raw effluent gas stream from the reaction zone is cooled to a temperature in the range of about 350° F. to 750° F. by direct or indirect heat exchange with water, and then cleaned with water in a gas-liquid contacting zone. A clean synthesis gas stream and an aqueous dispersion of said particulate solids, are thereby produced. At least a portion of the clean stream of synthesis gas in admixture with a vaporized condensate stream to be further described is reacted while in contact with a catalyst in a catalytic reaction zone. At least one water soluble gaseous impurity from the group consisting of HCN, COS, HCOOH, and mixtures thereof in said vaporized condensate stream is hydrolyzed while in contact with said catalyst. The stream of synthesis gas leaving the catalytic reaction zone is cooled below the dew point to condense out and separate water. At least a portion of this condensed water is recycled to the gas-liquid contacting zone to clean the raw synthesis gas stream prior to the first bed of hydrolysis catalyst. In the preferred embodiment, the remainder of the clean stream of synthesis gas is cooled below the dew point; and, the condensed water containing said water soluble gaseous impurities is separated. At least a portion of said condensed water is mixed with the stream of synthesis gas passing into a single bed of hydrolysis catalyst, or between any two beds of hydrolysis catalyst; thereby vaporizing said condensate stream and hydrolyzing said gaseous impurities to produce $H_2$ and carbon oxides.

In another embodiment the hot raw effluent gas stream from the reaction zone is quench cooled and scrubbed by direct contact with water in a gas cooling zone. A dispersion of quench water and particulate solids from the gas cooling zone is flashed to produce a gaseous stream comprising $H_2O$ and at least one water soluble gaseous impurity selected from the group consisting of HCN, COS, HCOOH and mixtures thereof. Water is condensed out from this gaseous stream and is separated along with said water soluble gaseous impurities. This stream of condensed water is mixed with the hot synthesis gas and vaporized. The gaseous mixture is then introduced into at least one bed of water-gas shift catalyst where said gaseous impurities are destroyed.

BRIEF DESCRIPTION OF THE DRAWING

The invention will be further understood by reference to the accompanying drawing. The drawing is a schematic representation of a preferred embodiment of the process.

DESCRIPTION OF THE INVENTION

Figure 1:
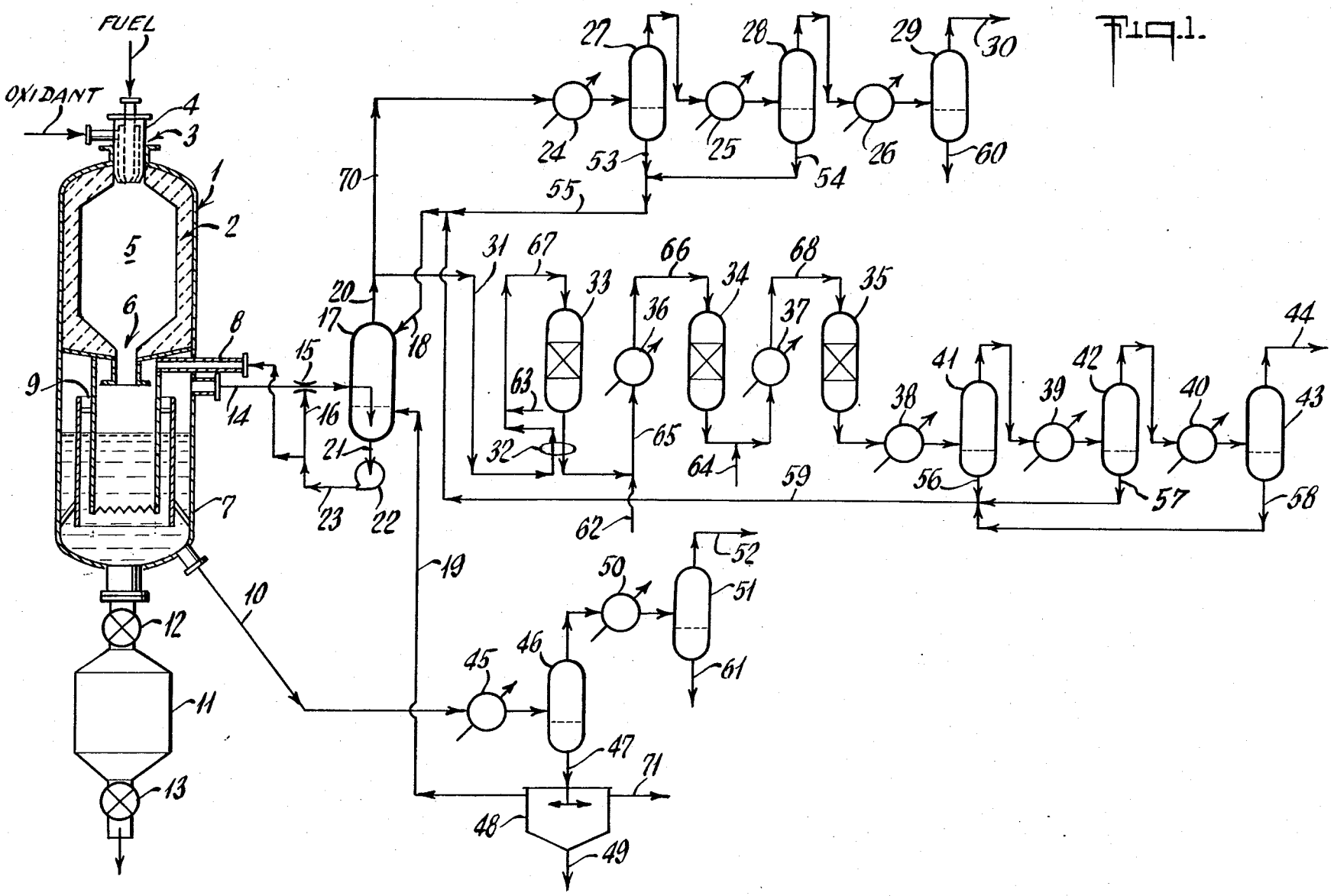

The present invention comprises a process for the treatment of process derived streams of condensate water which contain dissolved gaseous impurities, e.g., HCN, COS, HCOOH, and mixture thereof. The water is treated to eliminate substantially all of the hydrogen cyanide, most formates, most carbonyl sulfide, and some other gases which are susceptible to catalytic reactions with water. The process of the present invention is preferably used in conjunction with a process for the production of synthesis gas and most preferably used with a synthesis gas production process which uses a water-gas shift catalyst. The process of the present invention can also be used advantageously to treat waste water from some other sources wherein the waste water comprises a hydrogen cyanide rich water solution.

In the preferred embodiment, the raw synthesis gas produced in the subject partial oxidation process is cleaned and simultaneously cooled and humidified by quenching and scrubbing the gas in water. By this means, objectionable by-products may be removed from the synthesis gas. A substantial portion of the water soluble gases and soluble inorganic materials dissolve into the water while the insoluble materials are washed out of the synthesis gas and form an aqueous suspension of solid particulates with the wash water. Optionally, the synthesis gas can be further cleaned through the use of various scrubbing systems, wherein substantially all of the remaining soluble gases, remaining soluble inorganic materials, and any remaining insoluble solids are washed out of the synthesis gas. In another embodiment, the hot raw synthesis gas from the reaction zone of the partial oxidation gas generator is partially cooled in an indirect heat exchanger e.g. waste heat boiler and then further quenched, scrubbed and cleaned as previously described.

The water having dissolved gases, dissolved inorganic materials, and suspended solid materials from the quenching and/or scrubbing operations can be recycled through the synthesis gas producing system as a quenching medium, a scrubbing agent, or can be combined with a carbonaceous fuel to form part of the feedstock. Removal of suspended solids from the recycle water stream by such means as settling, filtering or centrifuging may be done, if desired for process reasons. The recycling of the water can continue until the concentration of certain dissolved by-products (principally halides) reaches a predetermined level. The concentrations are held at this predetermined level by withdrawing water from the system as a waste water stream which must be treated to remove objectionable materials. The maximum tolerable level of the by-products which in the recirculated water is generally that level of by-products which will not damage the various components of the synthesis gas producing system. When feedstocks are used which contain relatively large quantities of impurities, especially nonvolatile water soluble solids such as halide salts, the ability of the system to recycle the water is reduced, and larger quantities of water must be withdrawn from the system as a waste water stream which must treated.

The condensate water containing the dissolved gaseous impurities is treated by mixing it with hot synthesis gas which provides the heat to vaporize the water. The stream of synthesis gas is thereby saturated with water. The resulting gaseous mixture is then reacted over a water-gas shift catalyst or other operable hydrolyzed by the water-gas shift or other operable catalyst to form hydrogen, carbon monoxide, carbon dioxide, and ammonia. Formates present in the reacting gas stream are converted to hydrogen and carbon oxides, and carbonyl sulfide present in the gas is converted to hydrogen sulfide.

Soluble and insoluble nonvolatile materials, if any, are removed from the the water containing the gaseous impurities before it is vaporized. The water is vaporized by mixing it with the hot synthesis gas before the mixture enters the water-gas shift catalyst bed. The water containing the gaseous impurities may be introduced into the line or conduit carrying the synthesis gas into the first or only catalytic reactor. In a preferred embodiment incorporating the process of the present invention, there are two or more water-gas shift catalyst beds connected in series and the water containing gaseous impurities is added to the synthesis gas stream passing through the line or conduit connecting the two beds of water-gas shift catalyst.

The water that contacts the water-gas shift catalyst preferably contains only volatile impurities such as hydrogen cyanide and other gases. Dissolved inorganic solid solutes or suspended material can inactivate the catalyst and/or otherwise act to reduce its efficiency. The sensitivity of the catalyst to nonvolatile materials in the waste water will depend to a large degree on the type of catalyst used, and/or any associated process used to maintain the activity of the catalyst.

The preferred catalyst for use in the process of the present invention, is a low temperature water-gas shift catalyst resistant to sulfur. One such catalyst is cobalt-molybdenum on alumina. However, other catalysts capable of hydrolyzing hydrogen cyanide or otherwise reducing hydrogen cyanide, and preferably at least some of the other impurities e.g. COS and HCOOH are also useful in the present invention. The other catalysts can include one or a combination of metals from Group IB, IIB, VIB, VIIB, and VIII of the periodic chart of the elements.

Using the process of the present invention with the preferred synthesis gas production process, which already includes a water-gas shift catalyst bed, requires no additional equipment or major changes to be made to the synthesis gas production process other than the simple routing of at least a portion of the vaporized water which is substantially free of nonvolatile solutes and in admixture with the synthesis gas and gaseous impurities through the water-gas shift catalyst bed. Applicants' process is cheaper and simpler than the addition of scrubbing towers or the continuous use of relatively expensive chemical waste treatment systems to remove the cyanide and the other gaseous impurities from the waste water. Further, the problem of the disposing the chemical residue or of the concentrated acid gases is also eliminated by the process of the present invention. Advantageously, by the subject invention troublesome cyanide and formate constituents in the gas cooling and cleaning water may be converted into valuable and useful $H_2$ and CO.

DESCRIPTION OF THE DRAWING

Referring now to FIG. 1, an unobstructed free flow non-catalytic down-flowing partial oxidation gas generator 1 is depicted as being lined with a refractory material 2, and having an axially aligned inlet port 3, an annulus type burner 4, an unpacked reaction zone 5 and an outlet port 6 leading into a quench chamber 7. A carbonaceous fuel, preferably a liquid petroleum product or a ground, solid carbonaceous material suspended in a liquid such as water, is pumped through one inlet of annulus burner 4. An oxidant, consisting of a free-oxygen containing gas is also admitted into annulus burner 4 through another inlet. A temperature moderator such as water or steam, optionally can be introduced through either or both inlets of annulus burner 4 in admixture with the material passing therethrough.

A useful gas generator 1 is described in coassigned U.S. Pat. No. 2,809,104 issued to D. M. Strasser et al which is incorporated herein by reference. A useful annulus type burner 4 is more fully described in coassigned U.S. Pat. No. 2,928,460 issued to Du Bois Eastman et al, which is incorporated herein by references. Burners having other designs may also be used in the process shown in FIG. 1.

The annulus type burner 4 mixes an oxidant with the carbonaceous fuel and, optionally a temperature moderator. The mixture reacts within the reaction zone 5. The various quantities of carbonaceous fuel, oxidant and moderator are carefully controlled so that substantially all of the carbonaceous fuel is converted to gas, and so that the desired temperature range is maintained within the reaction zone 5. The raw synthesis gas exits the reaction zone 5 through bottom axial outlet port 6 and discharges into quench chamber 7 which is partially filled with water. Water is introduced into quench chamber 7 through line 8 into a dip tube-draft tube combination 9 where the water contacts and quenches the hot, raw synthesis gas. A portion of the water is removed from the quench chamber 7 in line 10. When the hot raw synthesis gas exiting from the generator 1 is mixed with water in the dip tube-draft tube 9 in quench vessel 7, some of the water is turned into steam. The synthesis gas is thereby humidified. Any molten slag present, such as when an ash containing fuel such as is coal is used, solidifies and can be removed from quench chamber 7 through water sealed lock hopper 11 which is equipped with isolation valves 12 and 13. Fine ash and incompletely gasified carbonaceous fuel particles are suspended in the water within the quench chamber 7 and are withdrawn with the water through line 10 at a temperature in the range of about 300° F. to 600° F. The aqueous suspension in line 10 contains particulates and at least one water soluble gaseous impurity from the group consisting of HCN, COS, HCOOH, and mixtures thereof.

Trace amounts of formic acid may be made by the reactions $CO+H_2O$ and when the hot raw synthesis gas is quench cooled in quench tank 7 and/or scrubbed with water in a gas cooling and scrubbing zone. A portion of the water soluble gaseous impurities are removed from the water suspension by first cooling the water suspension in heat exchanger 45 and then reducing its pressure and flashing it into flash tank 46, which is operated at substantially atmospheric pressure. A portion of the gaseous impurities which are dissolved in the water are thereby liberated in admixture with steam.

The water suspension passes from flash tank 46, through line 47 and into clarifier 48 where substantially all of the particulate matter is separated from the water by settling and is removed from the system as a sludge through line 49. The major portion of the overhead water from clarifier 48 is then returned to the scrubbing system through line 19 for reuse.

A small portion, typically from about 1 to 15 percent of the clarified water, is withdrawn fron the system through line 71 as a waste water stream to maintain the concentration of dissolved solids in the circulating water at an acceptable level from the standpoint of minimizing corrosion and, operating problems in the water system that can be caused by soluble materials. Halide salts are the major materials of concern. The size of the waste water stream depends on the amount of the soluble materials in the feed to the gasifier. This water must be further treated in processing units not shown, for removal of constituents of environmental concern before it is discarded.

The steam and gaseous impurities separated from the water in flash tank 46 are cooled in heat exchanger 50 to a temperature below the dew point and the aqueous condensate is collected in knockout pot 51. The cooled gases are withdrawn from the system through line 52 for treatment to remove objectionable components, in particular $H_2S$ and other sulfur containing compounds, prior to discharge. The condensate in line 61, containing at least one soluble gaseous impurity selected from the group consisting of HCN, COS, HCOOH, and mixtures thereof, is vaporized by being mixed with process derived synthesis gas. The mixture of gases are then reacted over a hydrolysis catalyst in the manner to be further described.

Synthesis gas containing a portion of the fine ash, carbon particles, and a portion of the water soluble gaseous impurities selected from the group consisting of HCN, COS, HCOOH, and mixtures thereof exits quench chamber 7 through line 14 at a temperature in the range of about 300° F. to 600° F. The quenched synthesis gas stream in line 14 is passed through a conventional venturi type scrubber 15, wherein the synthesis gas stream is scrubbed for removal of residual particles by water that is introduced through line 16.

Additional hydrogen cyanide, as well as other gases and inorganic materials in the synthesis gas, dissolve in the water during the gas scrubbing step. The resulting mixture of synthesis gas and water formed in scrubber 15 is directed into scrubbing water separator tank 17. Water for the scrubbing operation is introduced into separator tank 17 through lines 18 and 19. In separator tank 17, the synthesis gas and the water separate from each other. The synthesis gas is removed from the top of tank 17 through line 20. The water is passed through bottom line 21 to pump 22 from which it is sent to the venturi type scrubber 15 and quench chamber 7 by means of lines 23 and 16 and 23 and 8 respectively.

At least a portion e.g. about 10 to 100 vol. wt. %, such as about 20 to 80 vol. wt. % of the synthesis gas exiting separator tank 17, is further processed in a catalytic water-gas shift conversion zone, wherein the ratio of $H_2$ to CO is substantially increased by reacting CO and $H_2O$ to make $H_2$ and $CO_2$. The portion of the synthesis gas to be processed in this manner is passed through line 31 to heat exchanger 32 where it is heated to the required inlet temperature of the shift converter system e.g. about 350° F. to 800° F. The water-gas shift reaction is carried out in the three catalyst beds connected in series e.g. in reactors 33, 34 and 35. Interbed coolers 36 and 37 are used to remove the heat liberated by the exothermic water-gas shift reaction. The temperature that the water gas shift reaction is carried out depends to a large extent on the chemical composition of the catalyst. For example, synthesis gas at a temperature in the range of about 350° F. to 550° F. and at a pressure in the range of about 1 to 250 atmospheres such as about 8 to 135 atmospheres and preferably that of the gas generator less any normal pressure drop in the lines and equipment may be introduced into water-gas shift reaction zone using a low temperature water-gas shift catalyst comprised of cobalt-molybdenum having a chemical composition of in wt. % as follows: CoO 2.0–5.0, $MoO_3$ 8.0–16.0, MgO nil-20.0, and $A1_2O_3$ 55–85.0. A single steady state continuous flow fixed bed reactor may be used. Preferably, as shown in FIG. 1 the water-gas shift reaction zone comprises a plurality e.g. 2 to 5, such as 3 separate catalyst beds in series.

In the subject invention, process derived condensate water containing at least one soluble impurity from the group cnsisting of HCN, COS, HCOOH, and mixtures thereof from lines 60 and/or 61 is mixed directly with the hot synthesis gas passing into the first catalyst bed 33, or preferably into the line connecting any two catalyst beds through which the partially shifted synthesis gas is passed. By this means, (i) the condensate water is vaporized and thoroughly mixed with the synthesis gas; (ii) the addition of condensate water improves the chemical equilibrium; and (iii) the gaseous impurities in the condensate water are hydrolyzed when they contact the water-gas shift catalyst and are converted into additional $H_2$ and CO. Further, the flashing condensate serves to cool the hot synthesis gas passing between catalyst beds.

Alternatively, the water-gas shift or hydrolysis catalyst may be a high temperature catalyst comprising iron oxide. In such case, the temperature of the synthesis gas feed in admixture with the vaporized condensate including the gaseous impurities entering the bed of high temperature catalyst is in the range of about 600° F. to 800° F. The pressure is preferably that in the gas generator less normal pressure drop in the lines, equipment, and across the catalyst beds. Reference is made to coassigned U.S. Pat. No. 4,021,366 which is incorporated herein by reference, for the use of low and high temperature water-gas shift catalysts in the same reactor.

The mixture of synthesis gas and vaporized condensate after being water-gas shifted in catalytic reactors 33, 34 and 35, is then cooled in heat exchangers 38, 39 and 40 equipped with knockout pots 41, 42 and 43 respectively, to remove the condensate formed in the cooling. The resulting cooled and dehumidified product gas in line 44 has an increased $H_2$ to CO ratio and can be further processed and used in other units. Further, the cyanides and other water soluble gaseous impurities e.g. COS and HCOOH have been removed.

The remainder, if any of the synthesis gas from separator tank 17 and line 20, which is now substantially free of entrained particulates, may be used where the ratio of $H_2$ to CO in the raw effluent synthesis gas as produced is satisfactory. This portion of the synthesis gas is passed through line 70 and is cooled in heat exchangers 24, 25 and 26 to the dew point temperature, or below. For example, the gas in line 30 may be at a temperature in the range of about ambient to 150° F. The condensate formed in the cooling is removed in the knockout pots 27, 28 and 29 associated with exchangers 24, 25 and 26 respectively. The resulting cooled and dehumidified synthesis gas in line 30 can than be further processed and used in other units. The condensate in line 60 contains at least one water soluble gaseous impurity from the group consisting of HCN, COS, HCOOH, and mixtures thereof.

The process condensate water collected in the various knockout pots 27, 28, 29, 41, 42, 43 and 51 are suitable for reuse directly since they are essentially free of particulate matter and soluble salts. Because of the absence of particulates in these waters they are particularly useful as washwater in scrubbing water separator tank 17 to clean the synthesis gas stream. In FIG. 1, the water in knockout pots 27, 28, 41, 42, and 43 is reused in this manner and is recycled by lines 53 and 55, 54 and 55, 56 and 59, 57 and 59 and 58 and 59 respectively.

While the waters in knockout pots 29 and 51 could be reused in the same manner, in the preferred embodiment of the present invention, at least a portion of the condensate from vessels 29 and/or 51 pass through lines 60 and 61 respectively and is then passed through one or more of lines 62, 63, and 64 and injected into the hot synthesis gas. Thus, the condensate may be introduced through line 63 into the hot synthesis gas stream passing into line 67 and then into water-gas shift reactor 33. Preferably, the condensate carrying at least one soluble gaseous impurity from the group consisting of HCN, COS, HCOOH, and mixtures thereof is vaporized by mixing with the hot partially shifted synthesis gas stream passing in lines 65–66 between water-gas shift reaction chambers 33 and 34; and/or 34 and 35 e.g. 62 and 64 respectively. It has been unexpectedly found that hydrogen cyanide, formic acid, carbonyl sulfide, and other water soluble gaseous impurities tend to concentrate in the condensate in knockout pots 29 and 51.

The condensate that is mixed with the partially shifted synthesis gas stream and passed through in lines 66 and/or 68 is evaporated and the mixture of water vapor, gaseous impurities, and synthesis gas passes through the downstream shift converters. The gaseous impurities selected from the group consisting of hydrogen cyanide, formic acid, carbonyl sulfide and mixtures thereof are hydrolized by reaction with water over the shift conversion catalyst and converted to compounds that are more easily disposed of or do not need further treatment, or which in some cases may be of value in the process. The water injected through lines 62 and/or 64 cools the gas. Accordingly, the required size of heat exchanger 36 and/or 37 is reduced. It is necessary to remove the exothermic heat of reaction of the water gas shift reaction after reactors 33 and 34 in order to increase the carbon monoxide conversion in subsequent catalytic reactors. The extent of reaction is governed by thermodynamic equilibrium and is greater at lower temperatures. The water added to the synthesis gas likewise increases the potential carbon monoxide conversion because of its effect on the chemical equilibrium.

The amount of condensate that can be injected through lines 62, 63 and 64 is limited by the temperature that the synthesis gas stream can be cooled to. Condensation must be avoided. Further, the gas temperature is maintained above a desired operating temperature for the type of catalyst. The quantity of condensate water in any specific case depends on among other variables the system size and configuration, the operating pressure, the gas composition and the type of catalyst. Any water from knockout pots 29 and 52 that is not injected into the partially shifted gas streams can be reused by adding it to the water in line 18. If additional water can be injected, condensate from pot 28, which contains some of the undesirable gases, or an external water stream high in hydrogen cyanide or other hydrolized dissolved gases and essentially free of particulates and soluble mineral matter, could be used to advantage. Since water is consumed within the process in the shift conversion section a make-up water stream is added.

In the present invention, the quantities of hydrogen cyanide, formic acid, carbonyl sulfide and other hydrolizable gases found in the process water streams and waste water purge have been reduced below those found in process configurations where the condensate from knockout pots 29 and 51 was returned to tank 17 or settler 48 or purged from the system as a waste water stream requiring treatment. Advantageously, the reduced quantities of hydrogen cyanide and other contaminants will reduce waste water treatment requirements.

In another embodiment of the subject invention, the hot raw effluent gas stream from reaction zone 5 is cooled to a temperature in the range of about 350° F. to 750° F. by indirect heat exchange with water in a gas cooler, such as shown and described in coassigned U.S. Pat. No. 3,920,717, which is incorporated herein by reference. The cooled process gas stream is then cleaned by scrubbing with water such as by means of gas scrubber 15 in FIG. 1. Alternatively, a conventional gas scrubbing zone may be used, for example, the venturi or jet scrubber, as shown in coassigned U.S. Pat. No. 3,524,630, which is incorporated herein by reference. The remainder of the process is substantially the same as that described previously.

By definition the term liquid hydrocarbonaceous fuel is a petroleum or coal derived fuel selected from the group consisting of virgin crude, residua from petroleum distillation and cracking, petroleum distillate, reduced crude, whole crude, asphalt, coal tar, coal derived oil, and liquefied coal fractions shale oil, tar sand oil, and mixtures thereof. Solid carbonaceous fuels include by definition coal including subbituminous, bituminous, anthracite, and lignite, petroleum coke, organic waste materials, shale, and asphalt dispersed in a liquid or gaseous carrier. Liquid carriers include water, liquid hydrocarbons, and mixtures thereof and form a pumpable slurry with said solid carbonaceous fuel. Gaseous carriers include $CO_2$, $N_2$, $H_2$, and recycle synthesis gas.

By definition the term free-oxygen containing gas is selected from the group consisting of air, oxygen enriched air (more than 21 mole % oxygen) and substantially pure oxygen (at least 95 mole percent oxygen).

By definition the term temperature moderator is selected from the group consisting of water, steam, $CO_2$ and $N_2$.

The partial oxidation reaction for the production of gaseous mixtures comprising $H_2+CO$ takes place in a reducing atmosphere under the following conditions: temperature 1800° F. to 3000° F., such as about 2200° F. to 2700° F.; pressure - about 1 to 250 atmospheres, such as about 5 to 200 atmospheres; when steam or water is used as a temperature moderator, the $H_2O$/fuel weight ratio is in the range of about 0.1 to 5.0, such as about 0.2 to 0.9; and atomic ratio of free oxygen to carbon in the fuel (O/C ratio) is in the range of about 0.6 to 1.6, such as about 0.8 to 1.4.

The composition of the hot raw effluent gas stream directly leaving the reaction zone of the free-flow partial oxidation gas generator may comprise of the following, in mole percent: $H_2$ 10 to 70, CO 15 to 57, $CO_2$ 0.1 to 25, $H_2O$ 0.1 to 20, $CH_4$ nil to 28, $H_2S$ 0.05 to 2, COS 0.02 to 0.1, $N_2$ nil to 60, Ar nil to 2.0, $NH_3$ 0 to 0.023 and HCN 0.5 to 100 parts per million (weight basis). Particulate carbon is present in the range of about 0.2 to 20 weight % (basis carbon content in the feed). Ash is present in the range of about 0.5 to 5.0 wt. %, such as about 1.0 to 3.0 wt. % (basis total weight of fuel feed). Depending on the composition after removal of the entrained particulate carbon and ash by quench cooling and/or scrubbing with water and with or without dewatering the gas stream may be employed as synthesis gas, reducing gas or fuel gas.

Suitable unobstructed free-flow down-flowing refractory lined gas generators and burners that may be used in the production of synthesis gas, reducing gas, or fuel gas from these materials are described in coassigned U.S. Pat. Nos. 3,544,291; 3,545,926; 3,874,592; 3,847,564; and 4,525,175, which are incorporated herein by reference.

In order to conserve water and minimize the amount of external waste water treatment required, it is desirable to reuse as much of the water as possible. The extent of reuse is ultimately limited by the need to purge accumulating soluble inorganic salts, which are carried from the system in a waste water stream as previously described. Before reuse, particulate material must be substantially removed from the water to avoid equipment problems. If the carbonaceous fuel being gasified is a solid fuel or contains a substantial quantity of ash, or both, such as a coal, the processing sequence shown in FIG. 1 and described as follows would be used to remove particulates from the aqueous suspension of solids that forms in the quench chamber 7. If a liquid hydrocarbon, such as a crude oil residue, is used as the feedstock to the gasifier, then a decanter system such as that in coassigned U. S. Pat. No. 4,014,786, which is incorporated herein by reference may be used to remove carbon particulates from the carbon-water dispersion that forms in the bottom of the quench chamber.

Various modifications of the invention as herein before set forth may be made without departing from the spirit and scope thereof, and therefore, only such limitations should be made as are indicated in the appended claims.

I claim:

1. A partial oxidation process for the production of gaseous mixtures comprising $H_2+CO$ comprising:

(1) reacting the fuel feedstock in a free-flow reaction zone of a partial oxidation gas generator to produce a hot raw effluent gas stream at a temperature in the range of about 1800° F. to 3000° F. and a pressure in the range of about 5 to 200 atmospheres; wherein said hot raw effluent gas stream comprises $H_2$, CO, $H_2O$, at least one water soluble gaseous impurity from the group consisting of HCN, COS, HCOOH, and mixtures thereof; at least one gaseous impurity from the group consisting of $CO_2$, $H_2S$, $NH_3$, and entrained particulate solids and/or molten slag;

(2) cooling said hot raw effluent gas stream from (1) to a temperature in the range of about 350° F. to 750° F. by direct or indirect heat exchange with water, and cleaning said raw effluent gas stream with water in a gas-liquid contacting zone to produce a clean synthesis gas stream saturated with water and containing a portion of at least one water soluble gaseous impurity from the group consisting of HCN, COS, HCOOH, and mixtures thereof; and an aqueous suspension of solids containing the remainder of said water soluble gaseous impurities from the group consisting of HCN, COS, HCOOH, and mixtures thereof.

(3) reacting a first portion of the cleaned stream of synthesis gas from (2) in admixture with the vaporized condensed water from (6) in a catalytic reaction zone, thereby increasing the temperature and $H_2/CO$ ration of the stream of synthesis gas leaving said catalytic reaction zone and hydrolyzing said gaseous impurities from the group consisting of HCN, COS, HCOOH, and mixtures thereof;

(4) cooling the stream of synthesis gas leaving the catalytic reaction zone below the dew point, and separating condensed water therefrom and recycling at least a portion of said condensed water to said gas-liquid containing zone in (2) to clean said raw synthesis gas stream prior to said catalytic reaction zone;

(5) cooling the remainder of the cleaned stream of synthesis gas from (2) below the dew point; and separating condensed water containing at least one water soluble gaseous impurity from the group consisting of HCN, COS, HCOOH, and mixtures thereof from a stream of dewatered synthesis gas; and (6) mixing and vaporizing at least a portion of said condensed water from (5) with the stream of synthesis gas passing into said catalytic reaction zone in (3).

2. The process of claim 1 wherein said feedstock comprises a solid carbonaceous fuel and where the hot raw effluent gas stream from the partial oxidation reaction zone is cooled in (2) by direct immersion in a pool of water in a quench zone located below the reaction zone of the gas generator thereby producing said aqueous suspension of solids containing at least one gaseous impurity from the group consisting of HCN, COS, HCOOH, and mixtures thereof; and provided with the steps of:

(7) cooling said aqueous suspension of solids;

(8) reducing the pressure on said aqueous suspension, and flashing and separating a gaseous mixture comprising steam and at least one gaseous impurity from the group consisting of HCN, HCOOH, COS, and mixtures thereof from the aqueous slurry;

(9) cooling said gaseous mixture below the dew point and separating water-insoluble gaseous components from an aqueous condensate containing at least one water soluble gaseous impurity from the group consisting of HCN, COS, HCOOH, and mixtures thereof; and

(10) mixing and vaporizing at least a portion of said aqueous condensate from (9) with said stream of synthesis gas in (6).

3. The process of claim 2 wherein said solid carbonaceous fuel is selected from the group consisting of coal including subbituminous, bituminous, anthracite, and lignite; petroleum coke; organic waste materials; shale; and ashpalt dispersed in a liquid or gaseous carrier.

4. The process of claim 3 wherein said liquid carrier is selected from the group consisting of water, liquid hydrocarbons, and mixtures thereof and forms a pumpable slurry with said solid carbonaceous fuel.

5. The process of claim 1 wherein said fuel feedstock is a petroleum or coal derived liquid hydrocarbonaceous fuel.

6. The process of claim 5 wherein said liquid hydrocarbonaceous fuel is selected from the group consisting of virgin crude, residua from petroleum distillation and cracking, petroleum distillate, reduced crude, whole crude, asphalt, coal tar, coal derived oil and liquefied coal fractions, shale oil, tar sand oil, and mixtures thereof.

7. The process of claim 1 in which the catalyst reaction zone in step (3) includes a low temperature cobalt-molybdenum catalyst or a high temperature iron oxide catalyst.

8. The process of claim 1 in which the catalyst reaction zone in step (3) includes a metal selected from the group consisting of Group IB, Group IIB, Group VIB, Group VIIB, Group VIII, and mixtures thereof of the periodic chart of elements.

9. The process of claim 1 wherein the catalytic reaction zone in (3) comprises a single bed of catalyst, and provided with the step of introducing said condensate water into the stream of synthesis gas passing through a feed line to said bed of catalyst.

10. The process of claim 1 wherein the catalytic reaction zone in (3) comprises a plurality of beds of catalyst connected in series, and provided with the step of introducing said condensate water into the stream of synthesis gas passing through a feedline to the first bed of catalyst and/or through a line connecting any two beds of catalyst.

11. A partial oxidation process for the production of gaseous mixtures comprising $H_2+CO$ comprising:

(1) reacting a feedstock comprising a solid carbonaceous fuel in a free-flow reaction zone of a partial oxidation gas generator to produce a hot raw effuent gas stream at a temperature in the range of about 1800° F. to 3000° F. and a pressure in the range of about 5 to 200 atmospheres; wherein said hot raw effluent gas stream comprises $H_2$; CO; $H_2O$; at least one water soluble gseous impurity from the group consisting of HCN, COS, HCOOH, and mixtures thereof; at least one gaseous impurity from the group consisting of $CO_2$, $H_2S$, $NH_3$; and entrained particulate solids and/or molten slag;

(2) cooling the hot raw effluent gas stream from (1) by direct immersion in a pool of water in a quench zone located below the reaction zone of the gas generator thereby producing an aqueous suspension of solids containing at least one gaseous impurity from the group consisting of HCN, COS, HCOOH, and mixtures thereof and cleaning said raw effluent gas stream with water in a gas-liquid contacting zone to produce a clean synthesis gas stream containing a portion of at least one water soluble gaseous impurity from the group consisting of HCN, COS, HCOOH, and mixtures thereof; and an aqueous suspension of solids containing the remainder of said water soluble gaseous impurities from the group consisting of HCN, COS, HCOOH, and mixtures thereof;

(3) cooling said aqueous suspension of solids;

(4) reducing the pressure on said aqueous suspension, and flashing and separating a gaseous mixture comprising steam and at least one gaseous impurity from the group consisting of HCN, HCOOH, COS, and mixtures thereof from a thickened aqueous slurry;

(5) cooling said gaseous mixture from (4) below the dew point and separating water-insoluble gaseous components from a first aqueous condensate containing at least one water soluble gaseous impurity from the group consisting of HCN, COS, HCOOH, and mixtures thereof;

(6) mixing and vaporizing at least a portion of the first aqueous condensate from (5) and/or the second aqueous condensate from (9) with a portion of the synthesis gas from (2);

(7) reacting the mixture from (6) while in contact with a water-gas shift catalyst in a catalytic reaction zone, thereby increasing the temperature and $H_2/CO$ mole ratio of the stream of synthesis gas leaving the catalytic reaction zone and hydrolyzing said gaseous impurities from the group consisting of HCN, COS, HCOOH, and mixtures thereof;

(8) cooling the stream of synthesis gas leaving the catalytic reaction zone in (7) below the dew point, and separating condensed water therefrom and recycling at least a portion of said condensed water to said gas-liquid contacting zone in (2) to clean said raw synthesis gas stream; and (9) cooling the remainder of the cleaned stream of synthesis gas from step (2) below the dew point; and separating a second aqueous condensate containing at least one water soluble gaseous impurity from the group consisting of HCN, COS, HCOOH, and mixtures thereof from a stream of dewatered synthesis gas having substantially the $H_2/CO$ mole ratio as the hot raw effluent gas stream from (1).

12. The process of claim 11 wherein said solid carbonaceous fuel is selected from the group consisting of coal including subbituminous, bituminous, anthracite, and lignite; petroleum coke; organic waste materials; shale; and asphalt dispersed in a liquid or gaseous carrier.

13. The process of claim 12 wherein said liquid carrier is selected from the group consisting of water, liquid hydrocarbons, and mixtures thereof and forms a pumpable slurry with said solid carbonaceous fuel.

14. The process of claim 11 wherein said water-gas shift catalyst in step (7) comprises a low temperature cobalt-molybdenum catalyst or a high temperature iron oxide catalyst.

15. The process of claim 11 wherein the catalytic reaction zone in (7) comprises a single bed of catalyst, and provided with the step of introducing said first and/or second condensate water streams into the stream of synthesis gas passing through a feed line to said bed of catalyst.

16. The process of claim 11 wherein the catalytic reaction zone in (7) comprises a plurality of beds of catalyst connected in series, and provided with the step of introducing said first and/or second condensate water streams into the stream of synthesis gas passing through a feedline to the first bed of catalyst and/or through a line connecting any two beds of catalyst.

* * * * *